US005159697A

United States Patent [19]

Wirth

[11] Patent Number: 5,159,697

[45] Date of Patent: Oct. 27, 1992

[54] X-RAY TUBE TRANSIENT NOISE SUPPRESSION SYSTEM

[75] Inventor: William F. Wirth, Sullivan, Wis.

[73] Assignee: General Electric Company, Milwaukee, Wis.

[21] Appl. No.: 629,528

[22] Filed: Dec. 18, 1990

[51] Int. Cl.[5] ..... H05G 1/66

[52] U.S. Cl. ..... 378/93; 378/101; 378/111; 378/131

[58] Field of Search ..... 378/131, 93, 94, 101, 378/111, 112

[56] References Cited

U.S. PATENT DOCUMENTS

| | | | |
|---|---|---|---|
| 2,890,358 | 6/1959 | Cummings | 378/131 |
| 3,069,548 | 12/1962 | Bavor et al. | 250/103 |
| 3,197,719 | 7/1965 | Wells | 333/33 |
| 3,325,645 | 6/1967 | Splain | 250/103 |
| 3,636,355 | 1/1972 | James et al. | 250/102 |
| 4,065,673 | 12/1977 | Fiocca | 378/93 |
| 4,333,011 | 6/1982 | Mester | 250/409 |

*Primary Examiner*—Craig E. Church
*Attorney, Agent, or Firm*—Quarles & Brady

[57] ABSTRACT

An X-ray imaging apparatus has a vacuum tube with an envelope that contains an anode, a cathode and a filament. A motor has a rotor mechanically connected to the anode inside the envelope and a stator on the exterior of the envelope. The vacuum tube and the motor are enclosed in an electrically conductive casing which are grounded. A grounded shield of a conductive material is placed between the stator and the envelope to suppress high voltage discharges within the envelope from producing currents in a winding of the stator. Low pass filters are placed in series with each conductor between the vacuum tube and a power supply to suppress radio frequency signals produced by the high voltage discharges from being carried over the conductors.

19 Claims, 3 Drawing Sheets

X-RAY TUBE TRANSIENT NOISE SUPPRESSION SYSTEM

BACKGROUND OF THE INVENTION

The present invention relates to X-ray imaging apparatus, and more specifically to means for suppressing high frequency electrical noise produced by an X-ray tube of the apparatus.

The X-ray imaging apparatus includes a vacuum tube, having a cathode and an anode, which emit X-rays during operation. The cathode comprises a tungsten thermionic emitting source and focusing surfaces. The cathode assembly of an X-ray tube typically includes a filament that heats the assembly to an operating temperature. Upon the application of an applied voltage potential, the thermionically emitted electrons traverse the vacuum gap between the cathode and the anode, impacting the anode and thereby generating X-rays. X-ray tubes which are typically used for medical diagnostic imaging are operated at very high anode-cathode voltages, typically 40,000 to 150,000 volts.

This range of operating voltages produces intense electric fields in the vacuum between the anode and the cathode. Such fields are intensified by sharp edges and particles on the surface of the electrodes. If the electric field intensity becomes high enough, a high voltage instability, or discharge, called a "tube spit" occurs which partially vaporizes the irregularity that produced the high field intensity. If the new surface following the vaporization is not smooth enough to lower the electric field to a sufficiently low intensity, the process repeats itself at a high frequency until the surface will support the high voltage. This process is often called "seasoning" in the X-ray tube art and occurs occasionally throughout the life of an X-ray tube providing a means by which the tube cleans itself.

Unfortunately, the high voltage discharges excite the natural resonances of the electrical circuits inside the tube casing. The resulting high frequency oscillations, typically in the range of 100 megahertz, are conducted and radiated into electronic equipment in the vicinity of the X-ray apparatus. These oscillations often have very high power and can cause permanent damage to sensitive electronic components and, more commonly, misoperation of the electronic equipment.

The traditional method for reducing the effect of tube spits on nearby electronic equipment is to prevent the electrical noise from entering the equipment by enclosing the circuitry in metal housings and by careful design of a grounding system for those housings. Although such measures for reducing the effects of the electrical noise from tube spits are helpful to a degree, they often are not effective against very intense tube spits.

SUMMARY OF THE INVENTION

An X-ray imaging apparatus includes a vacuum tube that incorporates a cathode and an anode with an X-ray emissive surface. A common type of X-ray tube utilizes an induction motor to rotate a disk shaped anode. The motor has a rotor within the enclosure of the X-ray tube and coupled to the anode. A stator of the motor is mounted exteriorly around the portion of the X-ray tube enclosure which contains the rotor. The anode is rotated during operation of the tube so that an electron beam produced from the cathode impinges upon a relatively small area near the perimeter of the spinning disk.

The X-ray apparatus also includes a power supply which provides a high voltage potential across the anode and cathode, and a current to the filament of the X-ray tube. A rotor controller supplies electricity to the motor to produce rotation of the disk-shaped anode within the tube.

The principle object of the present invention is to provide a mechanism for suppressing high frequency electrical noise generated by a spit of the X-ray tube from being conducted and radiated from portions of the imaging apparatus containing the X-ray tube and power supply.

This mechanism can include a conductive shield between the X-ray tube and windings of the motor stator. Such shielding prevents the electrical discharge of a tube spit from capacitively coupling an electrical current within the stator windings. Thus, a specific object of the present invention is to provide shielding of electrical noise produced within the X-ray tube from producing currents in the stator windings of the anode motor for the tube.

Another object of the present invention is to provide a means for suppressing electrical noise produced within the X-ray tube from being conducted through the different electrical conductors coupled to components of the X-ray tube.

In accordance with this object, low pass filters can be coupled in series with high voltage supply lines between the tube and the power supply. Similar low pass filters may be coupled to each of the electrical conductors between the rotor controller and the stator winding of the motor. The different low pass electrical filters suppress signals above several megahertz, such as signals produced by tube spits which are in the 100 megahertz range. As an alternative embodiment to placing filters on high voltage conductors, the suppression of the electrical noise from tube spits can be accomplished by providing low pass filters on the low voltage input and output lines to the high voltage power supply of the X-ray tube.

DESCRIPTION OF THE PRESENT INVENTION

Figure 1:
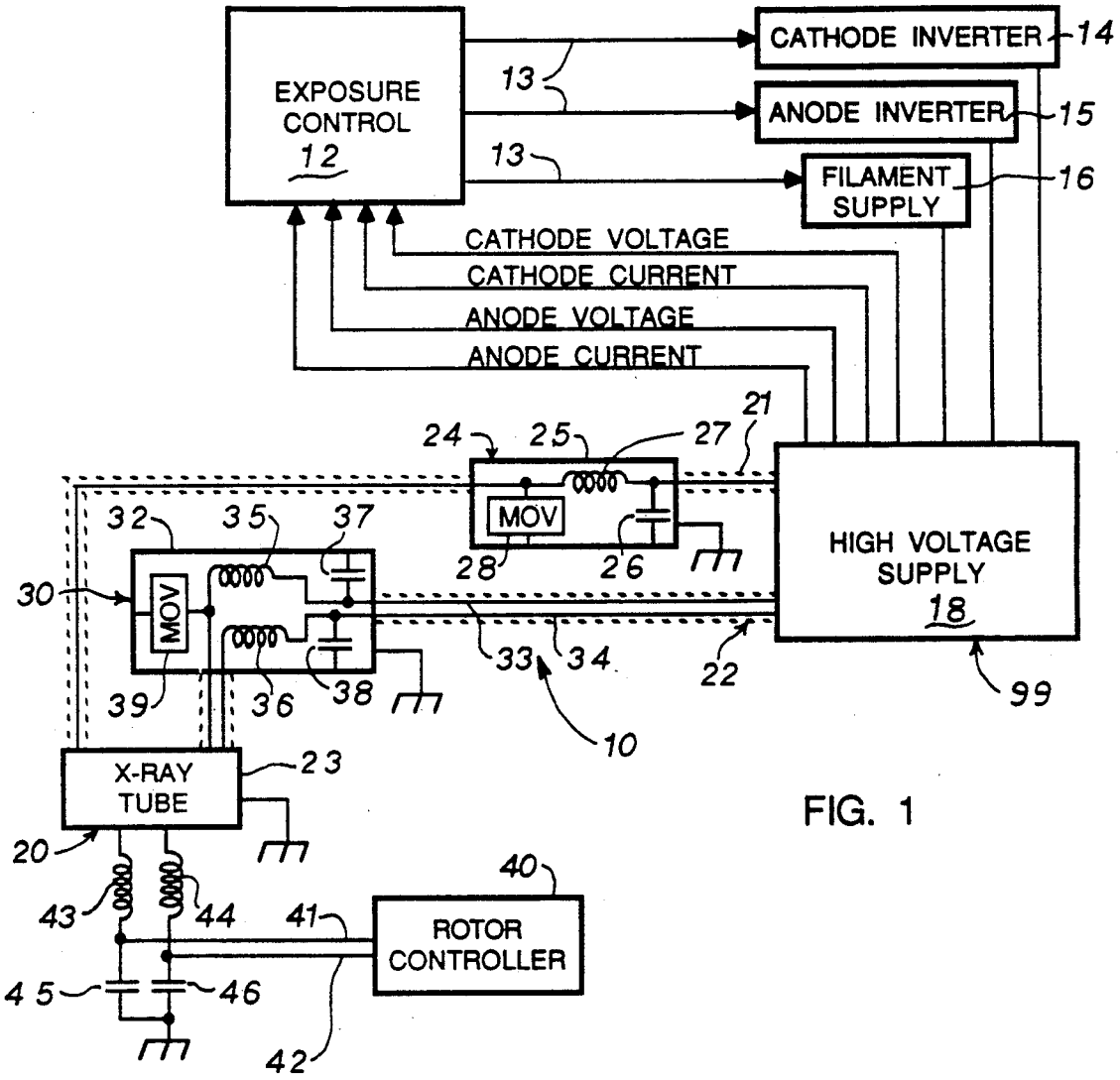
FIG. 1 is a block schematic diagram of an X-ray imaging apparatus which incorporates the elements of one embodiment of the present invention.

With initial reference to FIG. 1, an X-ray imaging apparatus, generally designated as 10, includes an exposure control 12 having a control panel through which an X-ray technician enters the parameters for a given exposure. Based on the input from the X-ray technician, the exposure control 12 produces a set of control signals on lines 13, which regulate the operation of a cathode inverter 14, an anode inverter 15 and a filament supply 16. The inverters 14 and 15 and the filament supply 16 form a low voltage power supply. The output voltages and currents from components 14–16 are governed by the exposure control 12 to produce the desired X-ray dosage for the exposure.

The cathode inverter 14 and anode inverter 15 supply relatively low voltage regulated electrical power to a high voltage supply 18 which boosts the voltages to produce the anode-cathode potential for the X-ray tube 20. The anode to cathode potential applied to the X-ray tube 20 is in the range of 40 to 150 kilovolts, for example. The components of the high voltage supply 18 are enclosed in a grounded, conductive housing which shields high frequency signals from radiating from the supply circuits to the exposure control or to other apparatus within the immediate vicinity.

The filament supply 16 furnishes current for application to a filament within the X-ray tube to heat the thermonic cathode to a desired operating temperature. Typically, the cathode and filament are contained in a single assembly within the tube, referred to as a "cathode filament," as illustrated by element 51 in FIG. 2.

The anode-cathode potential and filament current are applied by the high voltage supply 18 to a pair of cables 21 and 22 extending to the X-ray tube 20. The voltage potential for the anode is applied to the center conductor of coaxial anode cable 21 with the outer conductor being grounded to provide a shield for the anode potential. Similarly, twin axial cathode cable 22 carries the filament current and the cathode potential from the high voltage supply 18 to the X-ray tube. The outer coaxial shield of the second cable 22 also is grounded to the enclosure of the high voltage supply.

In series with the anode cable 21 is an in-line first low pass filter 24 assembly contained within a conductive enclosure 25. The shield of the anode cable 21 on both sides of the first filter 24 are connected to the conductive enclosure 25 which in turn is grounded. The center conductor of the anode cable 21 on both sides of the filter 24 are connected by an air core inductor 27. A capacitor 26 is coupled between the filter enclosure 25 and the end of inductor 27 which is connected to the high voltage supply 18. The combination of inductor 27 and capacitor 26 form a L-C low pass filter, the response characteristic of which has a cut-off between one and two megahertz to suppress radio frequency (RF) signals in the cable above that frequency. In some cases, the intrinsic capacitance of anode cable 21 may have a value which when combined with inductor 27 provides the suppression function without requiring a separate capacitor 26.

A first voltage limiter, such as a metal oxide varistor (MOV) 28, is coupled between the filter enclosure 25 and the other end of inductor 27 which is connected to the X-ray tube 20. The overall rating of the first MOV 28 must be greater than the maximum voltage which will be applied between the anode and ground, for example, a rating of 180 kilovolts. In practice, it may be difficult to find a single MOV with such a high rating and a number of lower voltage rated devices can be connected in series to achieve the desired rating. The first MOV 28 provides a shunt to ground for high voltage transients carried by the center conductor of anode cable 21. Other devices, such as a spark gap, a zener or an avalanche diode or a snubber circuit, can be used as a voltage limiter in place of the different metal oxide varistors in the present invention.

A second filter assembly 30 is connected in-line with the cathode cable 22. The second filter assembly 30 is contained within an electrically conductive enclosure 32 to which the outer conductive shield of the cathode cable 22 is connected on both the high voltage supply and X-ray tube sides of the filter 30. The second filter enclosure 32 is connected directly to ground. Each of the twin axial internal conductors 33 and 34 of the cathode cable 22 have sections on each side of the second filter 30. The sections of each of the twin axial conductors 33 and 34 are connected by air core inductors 35 and 36 wound in a biflar fashion within the enclosure 32. Separate capacitors 37 and 38 extend between the grounded enclosure 32 of the filter assembly and the end of each inductor 35 and 36 that is proximate to the high voltage power supply 18. Each set of an inductor and a capacitor in the second assembly 30 form separate L-C low pass filters for the respective twin axial conductor 33 and 34. Each of these low pass filters have a similar cut-off frequency to the low pass filter within the first assembly 24, i.e. one to two megahertz.

One of the internal conductors 33 in the cathode cable 22 has the high cathode voltage applied directly to it in supply 18. The tube end of the inductor 35 connected to this conductor 33 is connected to another voltage limiter, such as second metal oxide varistor (MOV) 39 which extends between that inductor and the grounded enclosure 32. The second MOV 39 has a similar rating as that of the first MOV 28. Alternatively, if bifilar inductors are not used in the second filter assembly, a separate MOV or other voltage limiter should be coupled to each internal conductor 33 and 34. The second filter assembly 30 provides low pass filter on each of the twin axial conductors of the cathode supply cable 22 and a high voltage transient suppression device on the conductor 33 which carries the high voltage to the cathode of the X-ray tube 20.

An anode motor of the X-ray tube 20 is driven by current carried through conductors 41 and 42 from a rotor controller 40. These conductors 41 and 42 are coupled to the stator windings in the X-ray tube 20 by separate inductor 43 and 44, respectively. The ends of the inductors 43 and 44, which are proximate to the rotor controller 40 are coupled to ground by separate capacitors 45 and 46. Each set of an inductor and a capacitor (43-45 and 44-46) in the circuit from the rotor controller 40 form additional low pass filters which suppress high frequencies from being conducted by the motor conductors 41 and 42. Each of these low pass filters has a similar cut off characteristic to those contained within assemblies 24 and 30 to filter out high frequency signals produced by a tube spit. The low pass filters should be located as close to the X-ray tube casing 23 as possible to prevent electrical noise from radiating from between the tube casing and the filters.

As is apparent from FIG. 1, each of the conductors extending out of the X-ray tube casing 23 is coupled to a low pass filter that suppresses any high frequency signals carried by that conductor. As each of the high voltage cables 21 and 22 are coaxial types having an outer grounded shield, the signal carrying conductors are encased within a grounded structure between the electrode of the X-ray tube and the filter. Specifically, the X-ray tube 20 is enclosed within a conductive casing 23 to which the shields of each of the high voltage cables 21 and 22 are electrically connected. In addition, each of the filter assemblies 24 and 30 have an outer electrically conductive enclosure 25 and 32, respectively, to which the shields of cables 21 and 22 also are electrically coupled. Therefore, the conductors carrying any high frequency signals produced by tube spit are encased in a grounded enclosure until reaching a filter element which will suppress those signals.

Figure 2:
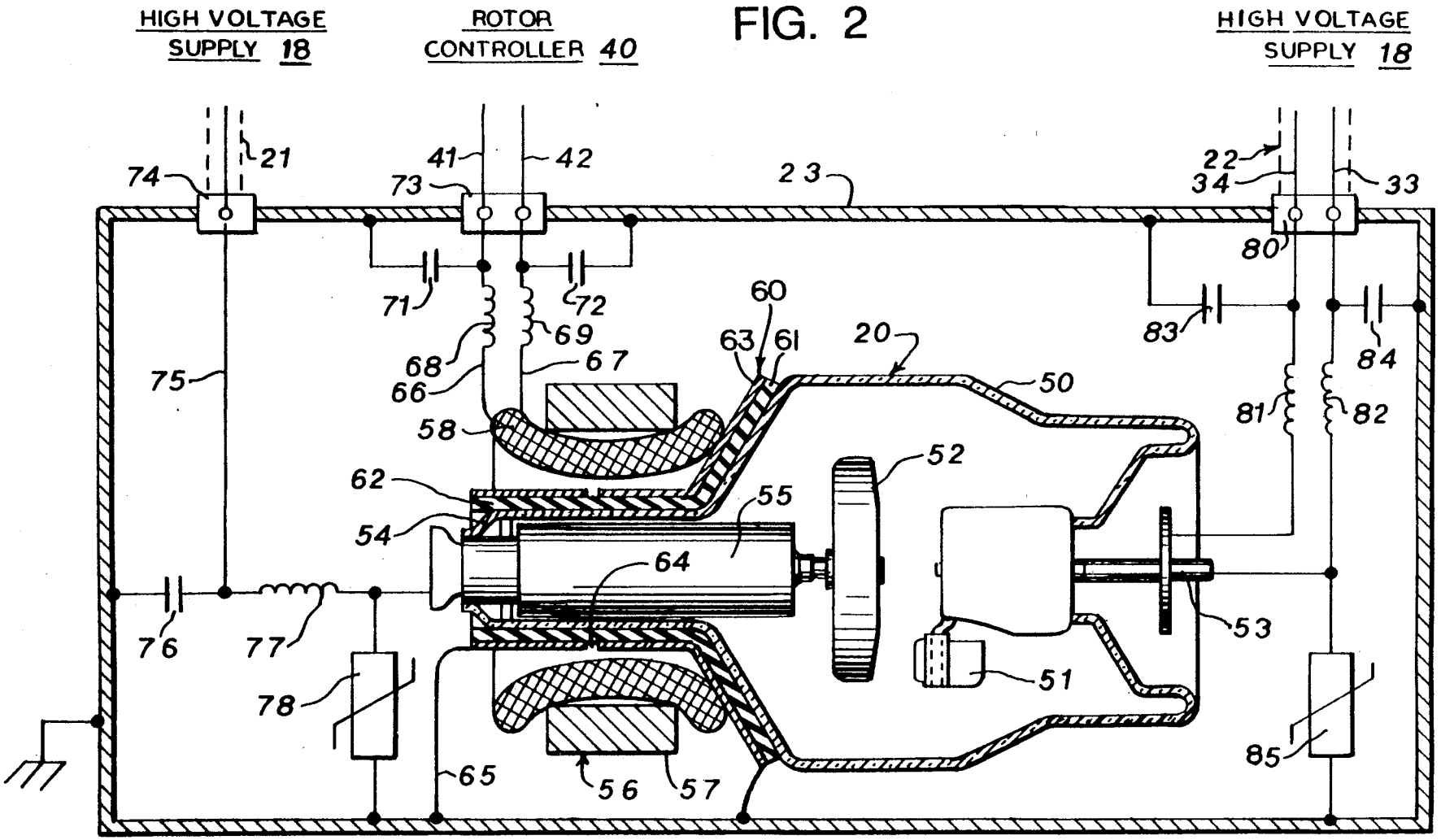
FIG. 2 is a cross-sectional view through the casing of an X-ray tube which has been modified according to another embodiment of the present invention.

With reference to FIG. 2, the low pass filters shown in FIG. 1 are incorporated within the conductive casing 23 which surrounds the X-ray tube 20, rather than in separate enclosures 25 and 32. In this alternative embodiment, cables 21 and 22 extend directly between supply 18 and tube casing 23 without in-line devices.

The X-ray tube 20 includes a glass envelope 50 which encloses a filament cathode 51 and a rotating anode 52. A connector 53 is at one end of the glass envelope 50 and electrically coupled to the cathode 51 to supply the high voltage potential and filament current to the cathode. The disk shaped anode 52 is mechanically connected to a rotor 55 which extends into a neck 54 of the glass envelope 50. A stator assembly 56 extends around the tube neck 54 forming a motor with the rotor 55 that drives the anode 52. The stator 56 includes a conventional laminated iron stack 57 through which a stator coil 58 is wound in a conventional manner. When a current from the rotor controller 40 is applied to the stator coil 58, a rotating magnetic field is produced within the neck portion 54 of the X-ray tube causing the rotor 55 and the anode 52 to rotate on the longitudinal axis of the X-ray tube 20.

Although the high voltage supply cables 21 and 22 to the anode and cathode of the X-ray tube are shielded to reduce RF emissions, a very prominent source of emissions from standard X-ray tubes results from tube spits producing current into the stator winding due to capacitive or inductive coupling. High frequency signals produced by the spits are carried out of the tube casing 23 on the stator current conductors 41 and 42 and then radiate from those conductors.

In order to reduce this noise emission, one aspect of the present invention provides a conductive shield 60 between the X-ray tube 20 and the stator 56. The shield 60 includes a flange 61 and a tubular section 62 both formed of a dielectric material. The tubular section 62 extends around the neck 54 of the X-ray tube 20 between the neck and the stator 56. The flange 61 extends outwardly from one end of the tubular section at an angle which conforms to the shape of the x-ray tube envelope.

A coating of conductive material is applied to the outer surface 63 of the shield 60 in FIG. 2. The conductive material covers the entire outer surface of both the flange portion 61 and the tubular section 62, with the exception of an annular gap 64 in the coating on the interior of the tubular section. The gap 64 provides a break in the coating to prevent the formation of a conductive path longitudinally along the tubular section 62 by the material. Such a conductive path could interfere with the magnetic coupling between the stator 56 and the rotor 55. The width of the gap 64 is sufficient to minimize the conductive path while still providing adequate RF shielding between the X-ray tube 20 and the stator winding 58. The conductive material on both sides of the gap 64 is electrically connected to the grounded tube casing 23.

As an alternative to a shield 60, the same function can be provided by an outer conductive coating on the stator coil 58. Instead of the shield 60, a conductive material such as a foil is wrapped around in the stator coil 58. As with the shield 60, an annular gap in the conductive material must exist around the inner diameter of the coil to eliminate a magnetic path in the material from adversely affecting the magnetic coupling between the stator 56 and rotor 55. The conductive material is grounded by a wire (not shown) extending between the material and tube casing 23.

The conductors 41 and 42 from the rotor controller 40 extend through a coupling 73 in the X-ray tube case 23. The coupling 73 is designed to minimize the area through which an RF signal may radiate.

The stator winding 58 has two leads 66 and 67 to which the current from the rotor controller is applied. Each of the leads 66 and 67 is coupled to the conductors 41 and 42 from the rotor controller 40 by a separate inductor 68 and 69, respectively. The ends of the two inductors 68 and 69 which are connected to the rotor controller conductors 41 and 42 also are coupled to the tube casing 23 by separate capacitors 71 and 72. Each combination of a capacitor and an inductor forms a low pass filter similar to that alternatively provided by components 43–46 on the exterior of the X-ray tube casing 23 in the embodiment of FIG. 1. Each of these low pass filters suppresses signals above a one to two megahertz cut-off frequency.

Although a single phase motor is illustrated in the drawings, a two or three phase motor can be used. In these cases, the stator winding 58 has an addition lead and another low pass filter coupled to that lead.

The combination of the conductive shield 60 and the low pass filters on the conductors from the rotor controller 40 serve to minimize a tube spit discharge from producing a signal in the stator winding 58, which signal then is conducted out of the tube casing 23. The shield 60 may also be utilized for an X-ray tube assembly in the embodiment of FIG. 1 where the low pass filters are external to the tube casing 23.

FIG. 2 also illustrates the use of low pass filters within the X-ray tube casing 23 in place of the in-line assemblies 24 and 30 in each of the anode and cathode supply cables 21 and 22. Instead, the supply cable 21 couples to a receptacle 74 in the casing which connects the shield of the cable 21 to the grounded casing 23. The central conductor 75 of the anode supply cable is coupled to the casing by a capacitor 76 and to the anode of the X-ray tube 20 by an inductor 77. An MOV 78 couples the anode terminal of the X-ray tube 20 to the casing 23. Thus, components 76, 77 and 78 comprise a filter assembly similar to element 24 in FIG. 1 for suppressing high frequency signals produced within the X-ray tube from travelling out of the casing 23 on the supply cable 21.

Similarly, the cathode cable 22 is connected to a receptacle 80 in the casing 23 which attaches the outer shield of the cable to the grounded casing. The internal twin axial conductors 33 and 34 extend into the casing where they are coupled by a pair of inductors 81 and 82 to the filament cathode terminal 53 of the X-ray tube. Separate capacitors 83 and 84 couple the casing 23 to the points of attachment of each of the supply cable conductors 33 and 34 to the inductors 81 and 82. The lead of cathode terminal 53 to which cable conductor 33 connects also is coupled to the tube casing 23 by another MOV 85. The circuit formed by components 81–85 constitutes a filter assembly within the casing 23 in place of external component 30 in FIG. 1, and prevents high frequency signals produced within the X-ray tube by the spits from being conducted out of the casing 23 over the cathode supply cable conductors 33 and 34.

Figure 3:
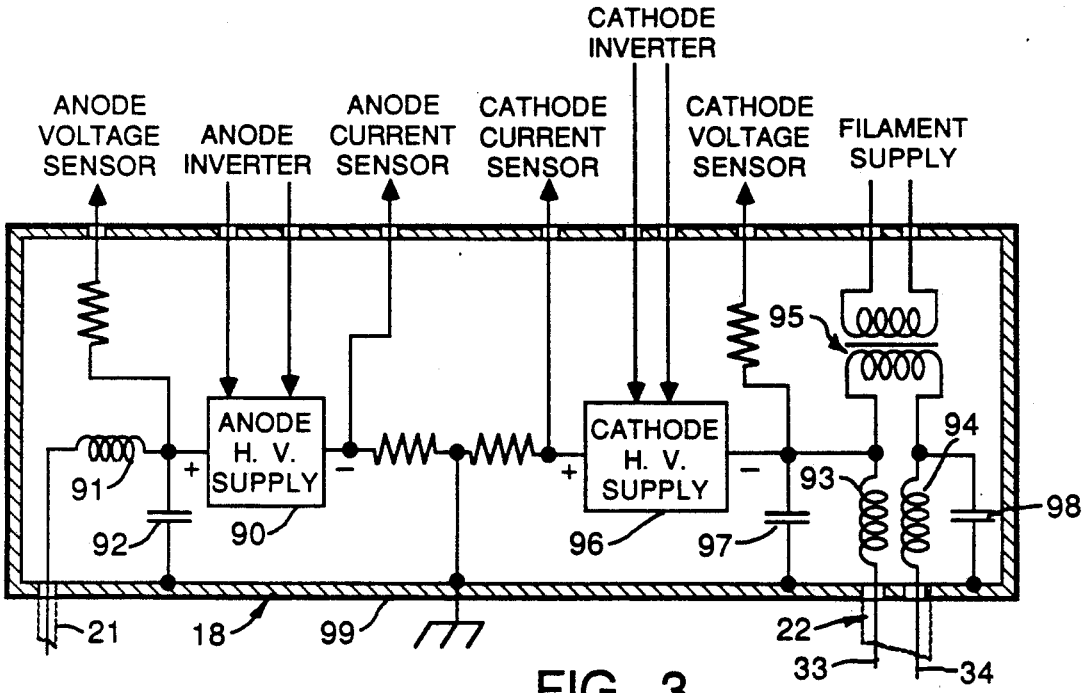
FIGS. 3 and 4 are schematic diagrams of different versions of a high voltage power supply for the tube which incorporate two further embodiments of the present invention.
Figure 4:
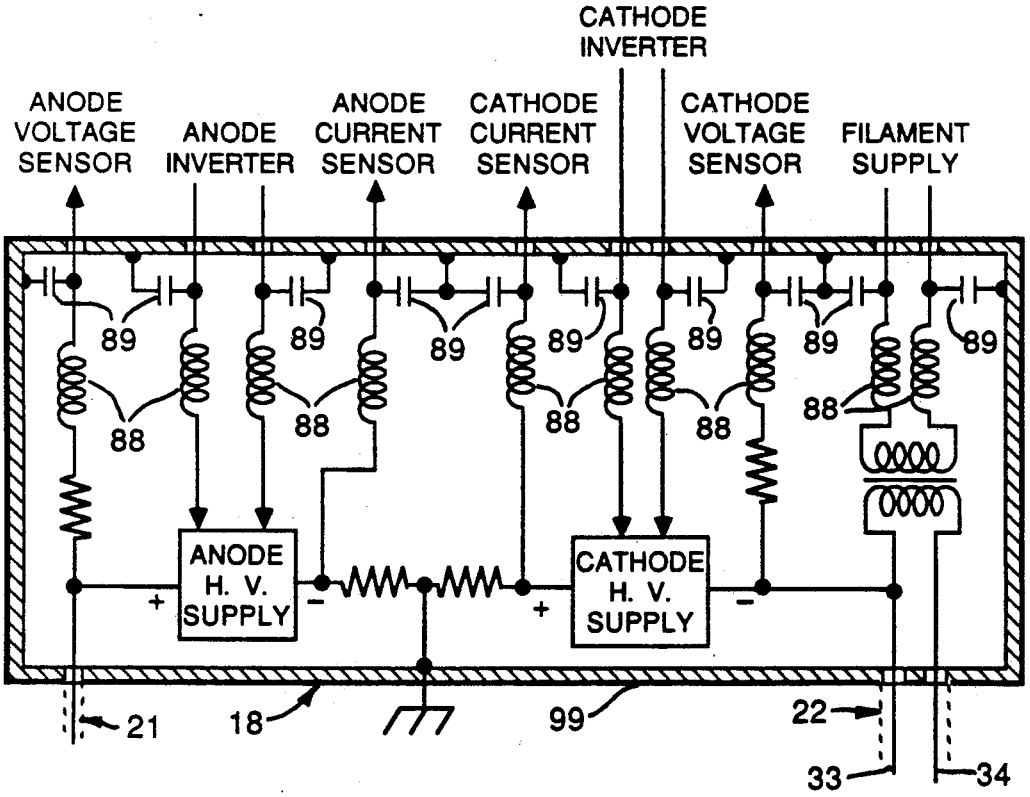

FIGS. 3 and 4 illustrate two further alternative embodiments of the present invention in which the suppression of high frequency signals carried by the high voltage cables 21 and 22 is performed within the high voltage supply 18. Considering first the embodiment in FIG. 3, the center conductor of coaxial anode cable 21 is coupled to the anode high voltage supply circuit 90 by a filter formed of inductor 91 and capacitor 92. This filter suppresses high frequency signals on that cable from being carried onto the lines that extend to the exposure control 12, inverters 14 and 15 and filament supply 16. Similarly with respect to the twin axial cathode supply cable 22, the inner conductors 33 and 34 are coupled by separate inductors 93 and 94 to a filament supply transformer 95. Inductor 93 also connects conductor 33 to the cathode high voltage supply 96. Capacitors 97 and 98 extend from modes between inductors 93 and 94 and the filament supply transformer 95 to the grounded conductive housing 99 of the high voltage supply 18.

Thus, the embodiment shown in FIG. 3 eliminates the use of in-line filter assemblies 24 and 30 shown in FIG. 1 by incorporating low pass filters at the terminus of the cables 21 and 22 within the high voltage supply 18.

Alternatively, the use of high voltage inductors and capacitors for the high frequency noise suppression function can be dispensed with by providing such low pass filters on the low voltage conductors extending into and out of the high voltage supply 18. Such low voltage conductors extend to the exposure control 12, inverters 14 and 15 and filament supply 16. Since both of the cables 21 and 22 between the high voltage supply 18 and the X-ray tube casing 23 are fully shielded, in effect, a single shielded enclosure is formed around the components of the X-ray tube, the conductors of the cable and the components of the high voltage supply 18. Such a unified shield prevents high frequency signals produced within the X-ray tube from radiating from either the tube casing 23 or the cables 21 and 22 so that the only exit point for radiation carried by the high voltage cables is out of the high voltage supply 18 on the low voltage conductors.

FIG. 4 illustrates how each of the low voltage lines extending from the housing of the high voltage supply 18 have low pass filters coupled thereto. Each filter is formed by an inductor 88 connected in series with the low voltage conductor, and a capacitor 89 coupled between the conductor and the grounded housing 99 of the high voltage supply 18. This provides a low pass filter with a cut-off in the one to two megahertz range on each of the low voltage conductors to suppress the high frequency noise signal produced by a tube spit from traveling out of the unified enclosure formed by the high voltage housing 99, the shield around cables 21 and 22 and the casing 23 of the X-ray tube 20.

It should be kept in mind that low pass filtering of the rotor controller lines shown in FIGS. 1 and 2 must still be provided with the embodiment of FIGS. 3 and 4.

I claim:

1. An X-ray imaging system comprising:

a vacuum tube assembly for emitting X-rays and including an envelope containing cathode electrode, an anode electrode and a filament, said vacuum tube assembly further including a motor having a rotor coupled to the anode within the envelope and having a stator external to the envelope;

an electrically conductive casing surrounding said vacuum tube assembly and coupled to ground potential;

an electrically conductive shield within said casing and around the envelope of said vacuum tube assembly between the electrodes and the stator, said shield having two sections spaced apart axially by a gap that extends around the envelope with each section being coupled to ground potential; and means for applying a high voltage between the anode and cathode and for applying a current to the filament of said vacuum tube.

2. The X-ray imaging system as recited in claim 1 further comprising:

a source of current for the motor;

first and second conductors connected to said source of current and to a winding of the stator for carrying current there between;

a first low pass filter connected in series with said first conductor between said source of current and a winding of the stator for suppressing radio frequency signals produced within said tube from being conducted by said first conductor to said source of current; and a second low pass filter connected in series with said second conductor between said source of current and the a winding of the stator for suppressing radio frequency signals produced within said tube from being conducted by said second conductor to said source of current.

3. The X-ray imaging system as recited in claim 1 wherein said means for applying a high voltage comprises a high voltage supply, a filament current supply, and a cable means for coupling the two supplies to said vacuum tube assembly and the cable means having first, second and third conductors surrounded by a grounded shield means; and said X-ray imaging system further comprising:

a first low pass filter connected in series with the first conductor between the anode electrode of said vacuum tube assembly and the high voltage supply; and a second low pass filter connected in series with the second conductor between the filament of said vacuum tube assembly and the filament current supply; and a third low pass filter connected in series with the third conductor between the filament of said vacuum tube assembly and the filament current supply; and each of the first, second and third low pass filters suppresses radio frequency signals produced within said vacuum tube assembly from being conducted by the cable means to the high voltage supply and the filament current supply.

4. The X-ray imaging system as recited in claim 3 further comprising a first voltage limiter means coupled between said first low pass filter and ground; and a second voltage limiter means coupled between ground and at least one of said second and third low pass filters.

5. The X-ray imaging system as recited in claim 1 wherein:

said means for applying a high voltage comprises a power supply means and a means for producing a high voltage in response to receiving a lower voltage from said power supply means; and said X-ray imaging system further comprising a low pass filter coupled to a conductor extending between said power supply means and said means for producing a high voltage.

6. A X-ray tube assembly for an imaging system comprising:

a vacuum tube for emitting X-rays including an envelope containing a cathode electrode and an anode electrode;

a motor having rotor within the envelope and mechanically attached to the anode, and a stator external to the envelope for generating a magnetic field that causes movement of the rotor;

an electrically conductive casing surrounding said vacuum tube and said motor; and an electrically conductive, grounded shield within said casing exterior to the envelope and extending between the electrodes and the stator, said shield for suppressing radio frequency signals produced by high voltage discharges within the vacuum tube from producing electric currents in the stator.

7. The X-ray tube assembly as recited in claim 6 further comprising:

a first low pass filter within said casing and coupled to the anode electrode; and a second low pass filter within said casing and coupled to the cathode electrode.

8. An X-ray imaging system comprising:

a vacuum tube for emitting X-rays and including a cathode, an anode and a filament;

an electrically conductive casing surrounding said vacuum tube and coupled to ground potential;

a power supply including a high voltage supply and a filament current supply;

a first cable having a central conductor for coupling the high voltage supply to the anode, and having a grounded shield surrounding the central conductor and connected to said conductive casing;

a second cable having a plurality of conductors for coupling the high voltage supply and the filament current supply to said to the cathode and filament, and having a grounded shield surrounding the plurality of conductors; and a plurality of low pass filters, one low pass filter connected in series with said central conductor between the anode and the high voltage supply, and separate low pass filter connected in series with each of the plurality of conductors in said second cable and between said vacuum tube and said power supply, each of the plurality of low pass filters for suppressing radio frequency signals produced within said vacuum tube assembly from being conducted by the respective first or second cable to said power supply.

9. The X-ray imaging system as recited in claim 8 further comprising:

a motor within said casing for producing rotational movement of the anode;

a source of motor current;

a pair of motor conductors; and first and second motor circuit low pass filters each connected in series with one of the pair of motor conductors between said source of motor current and said motor for suppressing radio frequency signals produced within said tube from being conducted by said pair of motor conductors.

10. The X-ray imaging system as recited in claim 9 wherein said motor is a multiple phase motor; and wherein said X-ray imaging system further comprises:

a third motor conductor; and a third low pass filter connected in series with said third motor conductor between said source of motor current and said motor, for suppressing radio frequency signals produced within said tube from being conducted by said third conductor.

11. The X-ray imaging system as recited in claim 8 further comprising a first voltage limiter coupling the anode to ground; and a second voltage limiter coupling the cathode to ground.

12. The X-ray imaging system as recited in claim 8 wherein each of said plurality of low pass filters are within said electrically conductive casing.

13. The X-ray imaging system as recited in claim 8 wherein each of said plurality of low pass filters comprises:

an inductor coupled in series which the conductor to which the filter is connected; and a capacitor coupled between said inductor and ground.

14. An X-ray imaging system comprising:

a means for controlling an X-ray exposure;

a vacuum tube for emitting X-rays and including a cathode, an anode and a filament;

an electrically conductive casing surrounding said vacuum tube and coupled to ground potential;

a power supply operated by said means for controlling and including an anode-cathode voltage supply and a filament current supply;

a high voltage supply, within a conductive housing, for increasing an anode-cathode voltage from said power supply to a higher voltage;

means for electrically coupling said vacuum tube to said high voltage supply;

a first plurality of conductors connecting said power supply to said high voltage supply; and a separate low pass filter coupled to each one of said first plurality of conductors for suppressing radio frequency signals.

15. The X-ray imaging system as recited in claim 14 further comprising:

a second plurality of conductors connecting said means for controlling an X-ray exposure to said high voltage supply; and a separate low pass filter coupled to each one of said second plurality of conductors for suppressing radio frequency signals.

16. The X-ray imaging system as recited in claim 14 further comprising:

a motor within said casing for producing rotational movement of the anode;

a source of motor current;

a pair of motor conductors; and first and second motor circuit low pass filters each connected in series with one of the pair of motor conductors between said source of motor current and said motor, for suppressing radio frequency signals.

17. The X-ray imaging system as recited in claim 14 further comprising:

a motor within said casing for producing rotational movement of the anode, and having a stator external to the vacuum tube; and an electrically conductive shield extending between said vacuum tube and the stator.

18. An X-ray imaging system comprising:

a vacuum tube for emitting X-rays and including an envelope containing cathode electrode, an anode electrode and a filament;

a motor coupled to the anode of said vacuum tube;

an electrically conductive casing surrounding said vacuum tube and said motor;

a source of motor current;

a pair of motor conductors; and first and second motor circuit low pass filters each connected in series with a different one of the motor conductors between said source of motor current and said motor, for suppressing radio frequency signals; and a means for exciting said vacuum tube to emit X-rays.

19. The X-ray imaging system as recited in claim 18 wherein said means for exciting comprises:

a power supply;

a plurality of electrical conductors; and a plurality of low pass filters with each low pass filter being connected in series with a different one of said plurality of conductors between said vacuum tube and said power supply, for suppressing radio frequency signals produced within said vacuum tube from being conducted by the respective conductor.

* * * * *